United States Patent [19]

Chapman

[11] 4,022,148

[45] May 10, 1977

[54] PORTABLE FIRE ALARM

[76] Inventor: Andrew Ernest Schofield Chapman, 16 Hawkshaw Avenue, Darwen, Lancashire, England

[22] Filed: Sept. 22, 1975

[21] Appl. No.: 615,569

[52] U.S. Cl. ..... 116/106; 116/112; 222/39

[51] Int. Cl.[2] ..... G08B 17/00

[58] Field of Search ..... 116/106, 114 S, 101, 116/114.5, 112; 169/42, 51, 52; 222/396, 397, 39, 173

[56] References Cited

UNITED STATES PATENTS

| | | | |
|---|---|---|---|
| 1,844,056 | 2/1932 | Bronander | 169/51 |
| 1,955,086 | 4/1934 | Pallotta | 169/51 |
| 2,034,179 | 3/1936 | Franklin | 116/106 |
| 2,362,423 | 11/1944 | Walsh | 116/114.5 |
| 2,626,586 | 1/1953 | Mendes | 116/106 |
| 2,777,416 | 1/1957 | Messick | 116/106 |
| 2,938,493 | 5/1960 | Pratt | 116/106 |
| 3,547,201 | 12/1970 | Balmes, Sr. | 169/42 |
| 3,667,419 | 6/1972 | Sullivan | 116/106 |
| 3,785,334 | 1/1974 | Waldeck | 116/106 |
| 3,897,828 | 8/1975 | Glover | 169/42 |
| 3,931,785 | 1/1976 | Keeley et al. | 116/106 |

*Primary Examiner*—Richard C. Queisser
*Assistant Examiner*—Daniel M. Yasich
*Attorney, Agent, or Firm*—Richard J. Hicks

[57] ABSTRACT

A self-contained fire alarm is described that is activated by a temperature-sensitive release mechanism. The alarm is a simple inexpensive device that requires minimal maintenance and is independent of any electrical power source.

1 Claim, 4 Drawing Figures

PORTABLE FIRE ALARM

This invention relates to fire alarm systems and particularly to non-electric fire alarms. Specifically, the apparatus of the present invention is a non-electric, self-contained fire alarm that is activated by a temperature-sensitive release mechanism.

The present fire alarm systems are divided generally between manually activated and automatic devices. The former are desirable because of their simplicity but have serious limitations since they are dependent on the presence of an operator.

Alternatively, automatic systems provided continuous protection when equipped with a suitable sensing device such as a bi-metallic strip or a smoke-detecting chemical which is normally used to complete electrical circuit. Invariably, these installations are expensive, either because of the cost of the sensing element and associated electrical circuitry, or, because numerous individual alarms are integrated into a complex alarm system powered by a central remote facility.

Self-contained fire alarm units have also been described in the art. These devices are also electrical, however, relying on a self-contained power system which is usually a battery. Batteries, and associated wiring, are susceptible to deterioration and malfunction particularly during the long periods of disuse that are inherent in the nature of fire protection systems. Accordingly, these devices require extensive and regular maintenance to ensure their capability of functioning in time of need.

A self-contained, non-electric fire alarm device has now been devised that is simple in design and powered by an inexpensive source that is reliably functional at all times without need for frequent maintenance.

Accordingly, an object of the present invention is to provide an inexpensive self-contained fire alarm of simple design.

A further object of the present invention is to provide a self-contained fire alarm that is independent of any electrical power source and is, therefore, characterized by its versatility and maintenance-free features.

According to one aspect of the invention there is provided a self-contained, non-electric fire alarm comprising sound producing means, means for operating said sound producing means, said means for operating the sound producing means being restrained by a material which softens, melts, loses adhesion or expands at a predetermined temperature and/or pressure whereby at said predetermined temperature and/or pressure the sound producing means is operated.

The means for operating the sound producing means may be, for example, a housing containing pressurised fluid or other form of self-contained, non-electric, source of energy such as a clockwork motor. When a housing containing pressurised fluid is employed an outlet in said housing is preferably closed by closure means which may be, for example, a valve, a plug of material as defined above or a membrane. The sound producing means, such as a horn, may be detachably secured to the outlet.

In a preferred embodiment of the invention the closure means comprises a plug of material such as wax which closes the outlet of the housing. At ambient temperature the wax is solid but as the temperature rises the wax softens until the plug ruptures allowing escape of fluid from the housing whereupon the sound producing means operates to produce an alarm.

In another embodiment of the invention the closure means comprises a valve which is held in the closed position by securing means comprising for example wax. As the temperature rises the wax softens and the securing means can no longer maintain the valve in the closed position so that fluid flows from the housing to sound an alarm. In some circumstances pressure of fluid in the housing at the predetermined temperature will assist in rupturing a membrane closing the outlet or in urging a valve to the open position.

A clockwork motor can be employed in combination with a hammer. Normally the hammer is restrained against movement by a plug of material as defined above. At the predetermined temperature the plug softens or melts to permit the hammer to strike a bell. Advantageously, the hammer is linked to the motor so that, when free to move, it performs a reciprocal motion and produces a succession of rapid rings.

Specific embodiments of the invention will now be described by way of example with reference to the accompanying drawings in which.

Figure 1:
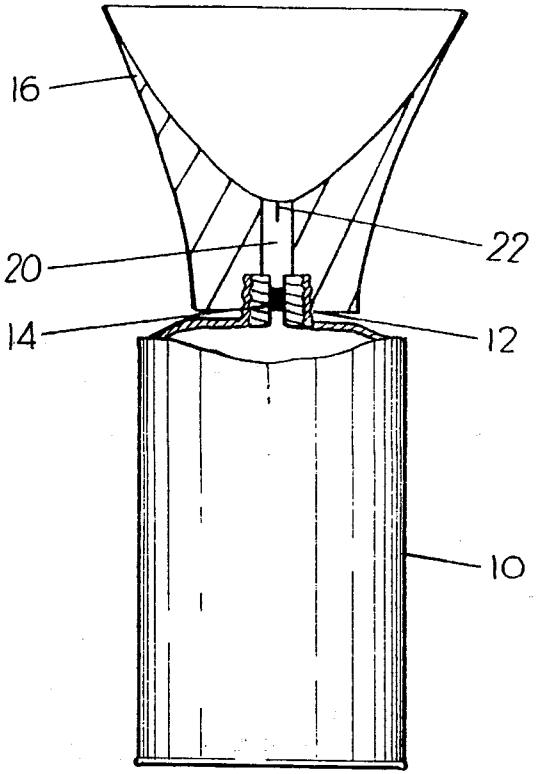
FIG. 1 shows a portable temperature sensitive alarm in side elevation and partly in section.

Referring to FIG. 1 of the drawings, the alarm comprises a cylindrical hollow body 10 which contains pressurised fluid such as compressed air. An externally threaded outlet 12 is provided at one end of the body 10, the outlet being closed by a plug 14 of material, for example wax, which is impermeable to the fluid in the body 10 at ambient temperature but which, at an elevated temperature will soften or melt to allow fluid to flow from the body through the outlet.

A horn 16 is threadedly engaged on the outlet 12. The horn includes a passageway 20 which, when the horn is engaged on the outlet, is in register with the outlet, there being a whistle or reed 22 in the passageway.

In use the alarm is placed at a loction where it is required that increase in temperature gives rise to an alarm. When the temperture rises to a level at which the plug softens or melts to allow fluid to flow from the body through the outlet and passage thus actuating the whistle or reed and generating an audible alarm.

With this embodiment there is no way of stopping the alarm, while pressurised fluid remains in the body, other than by reclosing the outlet. Normally, however, it is intended that the fluid in the body be exhausted when the alarm is triggered and that when the alarm is to be used again the exhausted body is removed from the horn and replaced by another body containing pressurised fluid and a plug in the outlet.

Figure 2:
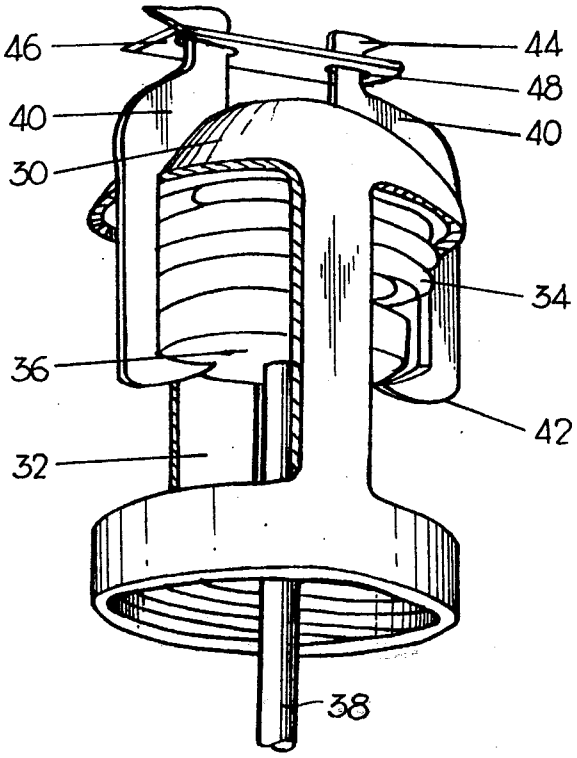
FIG. 2 illustrates a modified form of closure in perspective.

The outlet 12 can be closed by a valve (not shown) which is normally closed and which is opened by means of a temperature responsive device as shown in FIG. 2. The device shown in FIG. 2 comprises a hollow cylinder 30 which is closed at one end and has windows 32 on opposite sides thereof. A compression spring 34 is seated in the cylinder and bears against the closed end of the cylinder and a plate 36. A plunger 38 which projects through the open end of the cylinder is fixed to the plate 36.

The spring is held compressed and hence the plunger held retracted by two hooks 40. One end 42 of each hook projects through a window 32 and is located on the underside of the plate 36. The other end 44 of each hook is positioned on the outer side of the closed end of the cylinder. The hooks are held in position by a fastening strip 46 which is solid at room temperature, but which softens or melts at a predetermined temperature above normal room temperature. The strip has two holes 48 therein each of which receives an end 44 of a hook.

In use the device just described is fixed to the body of pressurised fluid whose outlet is closed by a valve. When the temperature rises the strip 46 softens and the hooks can no longer restrain the compression spring. The plunger is thus advanced causing the valve to open whereby fluid flows from the body to sound an alarm.

Figure 3:
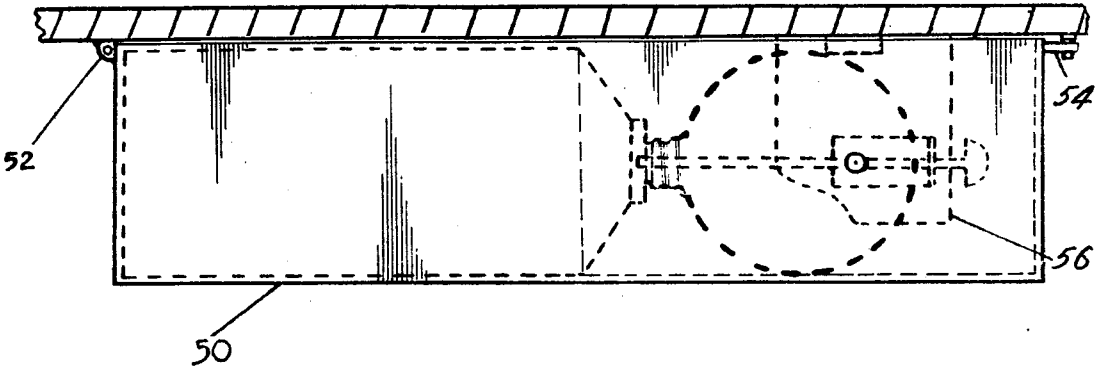
FIG. 3 is diagrammatic side elevations partly in section of a further embodiment of the invention.

Referring now to FIG. 3, the alarm is horizontally supported by a cover 50. The cover is hingedly mounted at 52 to the underside of a horizontal surface such as a ceiling and fastened by a clip 54 of wax or like material which is solid or adhesive at room temperature, but which melts, softens or loses adhesion when the temperature rises. The alarm is pivotally mounted on a bracket 56 fixed to the underside of the ceiling.

Figure 4:
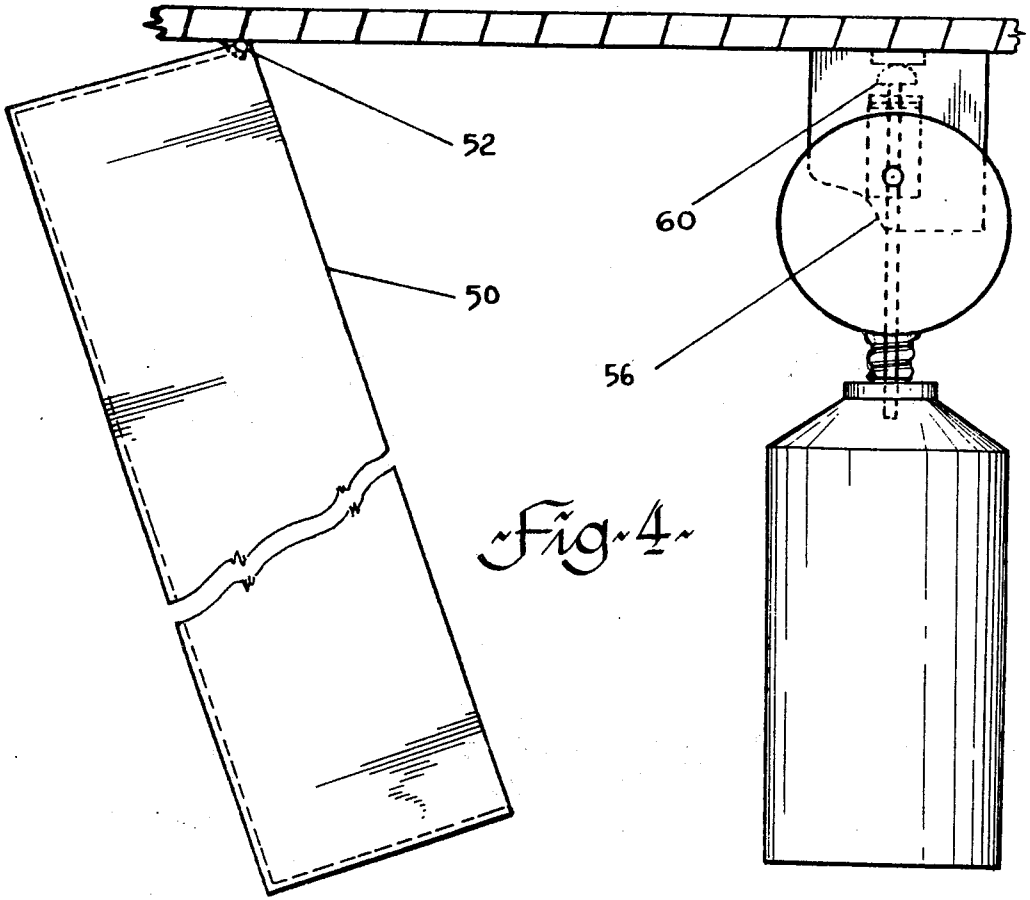
FIG. 4 illustrates the operation of the embodiments of FIG. 3.

In use the alarm is normally as shown in the drawings. If the temperture rises the wax plug softens or melts and the cover falls under gravity pivoting clockwise to the position shown in FIG. 4. The alarm is thus free to pivot anti-clockwise to the position shown in FIG. 4, whereupon a plunger 60 engages the ceiling or a seating provided for that purpose. The aforesaid engagement causes the plunger to be depressed and open a valve in the outlet of the body of pressurised fluid thus causing an alarm to be sounded.

When the alarm is mounted and operates horizontally as in the embodiment described with references to FIGS. 1 and 2 and an aerosol container is used for the supply of pressurized fluid it is desirable to arrange the dip tube in the aerosol so that its free end is directed upwardly and is above the level of the aerosol contents.

I claim:

1. In a self contained temperture sensitive fire alarm of the type wherein a sound producing means is actuated by a pressurized fluid released from a reservoir when a seal is broken as a result of fusion of a fusible plug at a preselected temperature, the improvement comprising: a cover for mounting on the underside of a substantially horizontal surface by means of a pivotal mounting at one end thereof and said fusible plug at the opposite end thereof; and a reservoir, housed within said cover and having a valve seal and associated plunger and striker means, for pivotal mounting on said horizontal surface at a position adjacent said fusible plug so that, upon fusion of said fusible plug as a result of a rise in ambient temperature to said preselected temperature, said cover and said reservoir pivot away from each other, under gravity, to a substantially vertical position in which said plunger contacts said striker means thereby depressing said plunger so as to break said valve seal and release said fluid.

* * * * *